US009869437B2

(12) United States Patent
Chien

(10) Patent No.: US 9,869,437 B2
(45) Date of Patent: Jan. 16, 2018

(54) MULTIPLE FUNCTION LED PROJECTION LIGHT HAVING BUILT-IN MOTOR MEANS

(71) Applicant: Tseng-Lu Chien, Walnut, CA (US)

(72) Inventor: Tseng-Lu Chien, Walnut, CA (US)

( * ) Notice: Subject to any disclaimer, the term of this patent is extended or adjusted under 35 U.S.C. 154(b) by 0 days.

(21) Appl. No.: 14/019,779

(22) Filed: Sep. 6, 2013

(65) Prior Publication Data

US 2015/0070876 A1 Mar. 12, 2015

(51) Int. Cl.

| | |
|---|---|
| ***F21V 33/00*** | (2006.01) |
| ***F21S 10/00*** | (2006.01) |
| ***F21S 8/00*** | (2006.01) |
| *F21Y 115/10* | (2016.01) |

(52) U.S. Cl.

CPC ..... *F21S 10/002* (2013.01); *F21S 8/035* (2013.01); *F21Y 2115/10* (2016.08)

(58) Field of Classification Search

CPC ..... F21S 10/002
USPC ..... 362/101
See application file for complete search history.

(56) References Cited

U.S. PATENT DOCUMENTS

| | | | | |
|---|---|---|---|---|
| 4,072,855 | A * | 2/1978 | Marchese | 362/101 |
| 4,797,796 | A * | 1/1989 | Eastman et al. | 362/199 |
| 5,416,994 | A * | 5/1995 | McLaughlin | 40/406 |
| 6,295,749 | B1 * | 10/2001 | Lin | G09F 19/08 40/406 |
| 7,186,016 | B2 * | 3/2007 | Jao | B44C 5/005 362/101 |
| 7,905,728 | B2 * | 3/2011 | Piontek | G09B 23/12 366/273 |
| 8,695,247 | B1 * | 4/2014 | Yang | 40/442 |
| 2003/0169588 | A1 * | 9/2003 | Kohn et al. | 362/101 |
| 2005/0036317 | A1 * | 2/2005 | Niskanen | 362/294 |
| 2006/0221617 | A1 * | 10/2006 | Chien | 362/311 |
| 2009/0061726 | A1 * | 3/2009 | Levinson et al. | 446/15 |
| 2010/0276508 | A1 * | 11/2010 | Davies | B05B 17/08 239/18 |

* cited by examiner

*Primary Examiner* — Bryon T Gyllstrom
(74) *Attorney, Agent, or Firm* — Bacon & Thomas, PLLC

(57) ABSTRACT

An LED light device includes a liquid container with floating miniatures. The miniatures are caused to move by a propeller driven through a magnetic coupling by a motor. Light from at least one LED passes through the liquid container and is projected onto another surface such as a wall or ceiling. The liquid moved by the propeller can be caused to move relatively slowly through a large opening or be accelerated by passage through a relatively small opening for liquid dance effects.

9 Claims, 9 Drawing Sheets

FIG 2-2
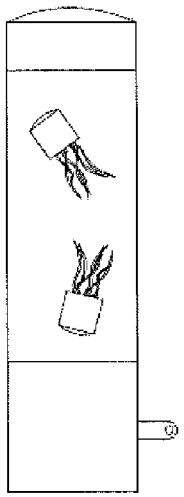
FIG 2-1
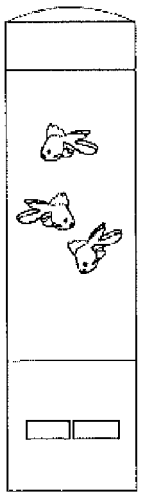
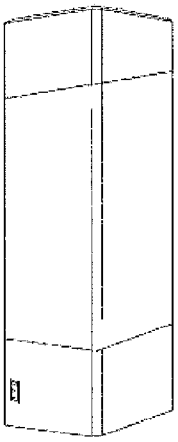
FIG 2-4
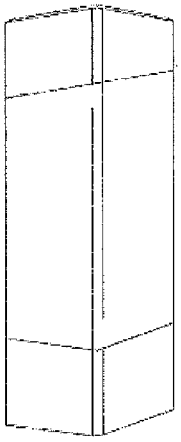
FIG 2-3
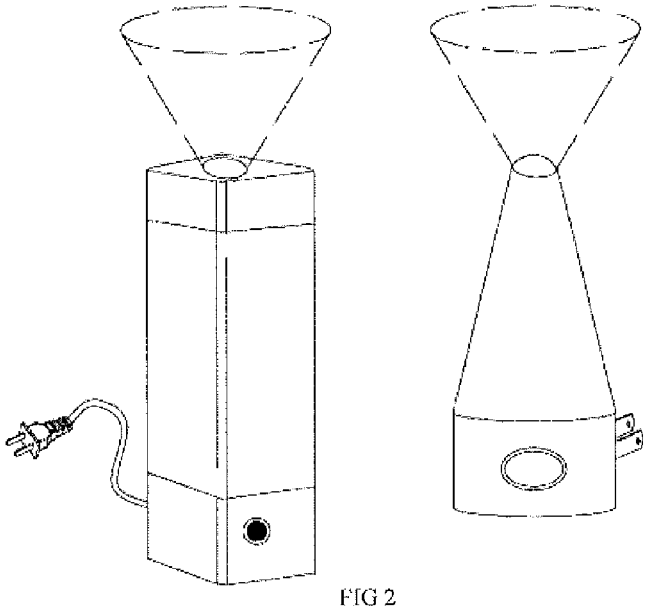
FIG 2

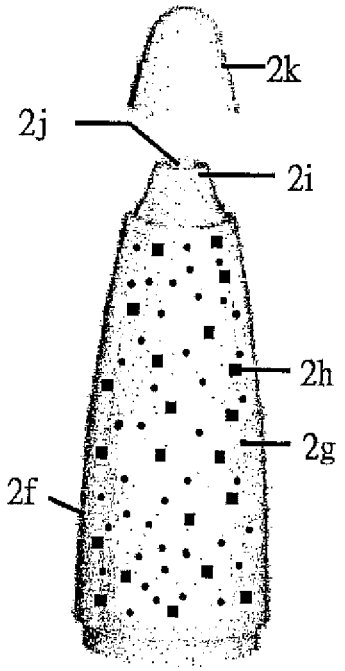
Fig 2-5
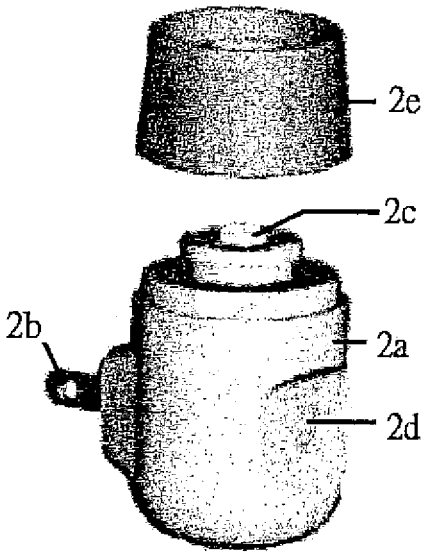

FIG 3-2
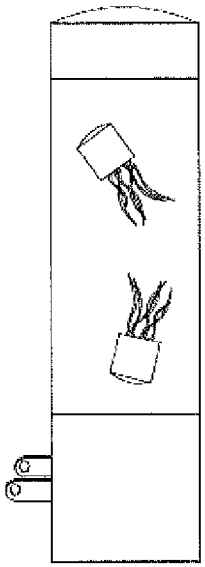
FIG 3-1
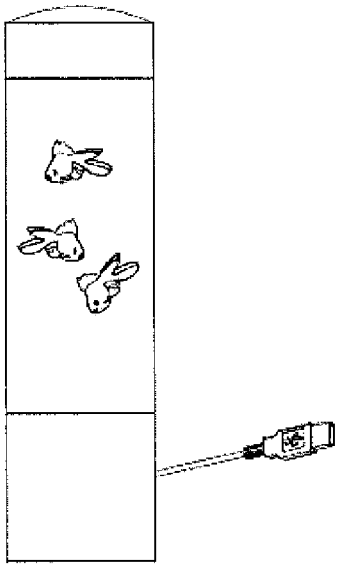
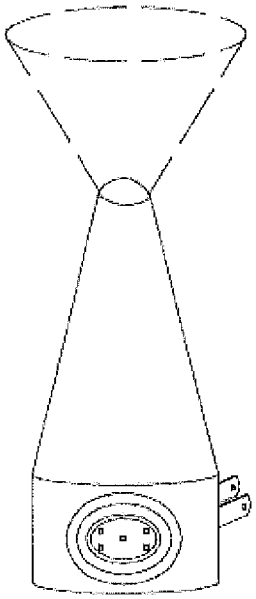
FIG 3
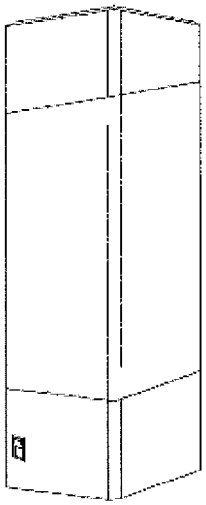
FIG 3-4
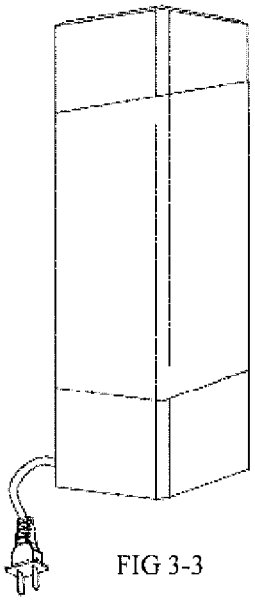
FIG 3-3

MULTIPLE FUNCTION LED PROJECTION LIGHT HAVING BUILT-IN MOTOR MEANS

BACKGROUND OF THE INVENTION

This application has subject matter in common with the inventor's prior U.S. patent application Ser. No. 12/938,564, filed Nov. 3, 2010, and published on May 3, 2012, as Pub. No. 2012/0106132; and U.S. Pat. Nos. 7,455,444, 7,632,004, 7,832,917, 7,892,918, 7,909,477, 8,029,182, 8,083,377, 8,128,274, 8,231,260, 8,277,087, 8,303,150, 8,303,158, 8,408,736, and 8,434,927, and the inventor's U.S. patent application Ser. No. 12/950,017, filed Nov. 19, 2010, Ser. No. 13/117,227, filed May 27, 2011, Ser. No. 13/161,643, filed Jun. 16, 2011, and Ser. No. 11/806,285, filed May 31, 2007.

Additional LED related application of the inventor describing a projection light (2) more than one function (3) adjustable focus (4) adjustable angle (5) elastic contact points (6) an LED heat solution (7) heat sensitive parts installation (8) extendable means and other features that might be utilized in the current invention include U.S. patent application Ser. Nos. 13/923,721, 12/910,295, 13/870,447, 13/870,253, 13/863,073, 13/858,064, 13/549,728, 13/402,247, 13/267,816, 13/367,758, 13/367,687, 13/296,508, 13/296,469, 13/295,301, 13/162,824, 13/161,643, 13/117,227, 13/021,107, 12/950,017, 12/948,953, 12/951,501, 12/938,564, 12/938,798, 12/938,628, 12/886,832, 12/876,507, 12/887,700, 13/021,124, 12/771,003, 12/711,456, 12/710,918, 12/710,561, 12/540,689, 13/534,611, 12/624,621, 13/295,562, 12/622,000, 13/019,331, 12/318,470, 12/914,584, 12/940,255, 12/318,473, 12/834,435, 12/292,153, 12/907,443, 12/232,505, 12/232,035, 12/149,963, 12/149,964, 12/073,095, 12/073,889, 12/073,809, 11/806,711, 11/806,285, 12/566,322, 11/498,874, and 12/502,661.

Each of the above-listed prior U.S. patent applications or patents of the inventor apply physics optical theory to LED lights for outdoor or indoor applications powered by alternating current (AC) or direct current (DC) connected by an electric cord to a plug for an outlet, or to a battery, transformer, solar power source, or other power source to create a plurality of LED light beams and illuminate close areas, or remote areas by a projection means and/or other features that may be included in the present invention, such as more than one light source, more than one function, more than one optics means, more than one projection means, super power saving circuitry, and cost saving concepts.

None of the prior art shows an LED night light having the multiple functions, projection features, and moving miniatures of the current invention. Furthermore, none shows an LED Night light with moving proper-density/weight floating miniatures and a propeller that causes movement in different directions and speeds via appropriate input and output openings inside a liquid container, and in a preferred embodiment of the present invention.

Prior U.S. patents other than those of the inventor listed above include U.S. Pat. Nos. 4,072,855, 5,416,994, 5,678,918, 6,517,231, 6,877,883, 7,905,728, 7,909,477, 7,784,959, Patent Pub. Nos. 2006-0215397, and 2009-0135586, all of which show motor/propeller applications but not for a multiple function LED light with the features described below.

The current invention provides an LED lava light which has no toxic liquid material within the compartment. It also does not have a heater means which may cause big fire hazard when overheating occurs. It is optional designed to allow consumers to add a pure or good liquid into the container to permit the light to be carried onto an airline without worry that the liquid/fluid will present a danger.

The LED lava light of the current invention uses a motor incorporated with magnetic means to cause the propeller to rotate and make the liquid flow in desired directions, thereby causing inner miniatures to move in a splendid motion for illumination and projection light performance. In addition, it is possible to add more than one LED (as described in the inventor's U.S. Pat. No. 7,455,444) and more than one optics means, as described in the inventor's U.S. Pat. No. 7,632,004. Further description of these features can be found in the inventor's U.S. Pat. No. 7,832,917 (projection night light), U.S. Pat. No. 7,892,918 (projection night light), U.S. Pat. No. 7,909,477 (aquarium night light), U.S. Pat. No. 8,029,182 (aquarium night light), U.S. Pat. No. 8,083,377 (projection night light), U.S. Pat. No. 8,128,274 (projection night light), U.S. Pat. No. 8,231,260 (projection night light), U.S. Pat. No. 8,277,087 (LED light having more than one reflector means), U.S. Pat. No. 8,303,150 (projection LED light for seasonal light), U.S. Pat. No. 8,303,158 (LED light having special light effects), U.S. Pat. No. 8,408,736 (LED light device having projection light beams), U.S. Pat. No. 8,434,927 (LED light having interchangeable power source).

The current invention has the advantages of (1) non-toxic liquid, and (2) no heat hazard, to provide a big improvement prior LED lava lights, and in addition may offer the following advantages:

(3) projection light performance to all desired areas;

(4) more than one LED to offer color changing light effects under built-in IC control for color, duration, sequential, flashing, and other functions available from marketplace;

(5) a motor designed for liquid flow direction with input and output end openings that are small or big to create different fluid movements for different liquid shows, as required, including water dance, water wave, and Aurora light effects for projection onto a desired location and provide a multiple function LED light unit;

(6) motor revolutions per minute (RPM) can be programmed by the built-in IC or activated by a sound activated circuit or any motion or vibration sensor, sound, remote control, infrared controller, or switch means available on the market;

(7) optics means such as a convex lens, reflective lens, kaleidoscope means, laser means, hologram means, mirrors, lenses or any optics related parts and accessories can be added to create more eye-catching effects, functions, and performance.

(8) The water level can be varied for different functions: When the liquid/fluid level is almost full or higher than the input and output openings, the liquid/fluid flow will cause the inner floating miniature stuff, When the liquid/fluid level is just over the input and output openings, the liquid/fluid can be arranged to pass through narrow cross-sectional areas, for example with a narrow diameter, so that the liquid/fluid speed will increase to a high speed and cause peaks that function like a water dance.

(it is to be appreciated that the liquid/fluid is not limited to water, oil, chemicals, compounds, or smoke, but can also use solid particles, polyform particles, or polygonal balls, artificial plastic snowflakes, or other solid particles, pieces, or balls);

(9) the motor means which has built-in optics means is on the top of the container to facilitate projection of the colorful changeable LED light beams, images, display units, or geometrically-shaped images to desired locations including ceiling and walls;

(10) circuit means can be used to create different LED light shows, show times, duration, function, and motor RPM through traditional or conventional market available IC technical and control means, switch means, sensor means, trigger means to cause the LED light device to have eye-catching light effects, moving stuff, projection light beams, or projection images;

(11) the power supply for the current LED light, which has motor means and projection functions and moving stuff/particle/liquid functions, may be selected from any combination of plug-in prong means, USB-power with USB kits, adaptor with UL-listed transformer, battery pack with preferred kits, the inventor's interchangeable power source means, or any other energy source or storage means;

(12) the multiple function not only can include the above-mentioned projection function, moving-stuff function, and LED light function, but also any of the other functions described in the inventor's other patent applications and issued patents.

BRIEF DESCRIPTION OF THE DRAWINGS

FIG. 2 is a perspective view of a night light with a liquid container according to a preferred embodiment of the present invention.

FIGS. 2-1 to 2-2 are side views of the night light of FIG. 2.

FIGS. 2-3 to 2-4 are additional perspective views of the night light of FIG. 2.

FIG. 3 is a perspective view of a night light with a liquid container according to another preferred embodiment of the present invention.

FIGS. 3-1 to 3-2 are side views of the night light of FIG. 3.

FIGS. 3-3 to 3-4 are additional perspective views of the night light of FIG. 3.

FIGS. 4 and 4-1 are perspective views of a liquid moving mechanism for use in the preferred night lights.

FIG. 4-2 is a top view of the mechanism of FIGS. 4 and 4-1.

FIGS. 5 and 5-1 to 5-4 are perspective views showing variations of the mechanism of FIGS. 4 and 4-1.

FIGS. 6 and 6-1 are perspective views showing variations of the mechanism of FIGS. 4 and 4-1.

DETAILED DESCRIPTION OF THE PREFERRED EMBODIMENTS

Figure 1:
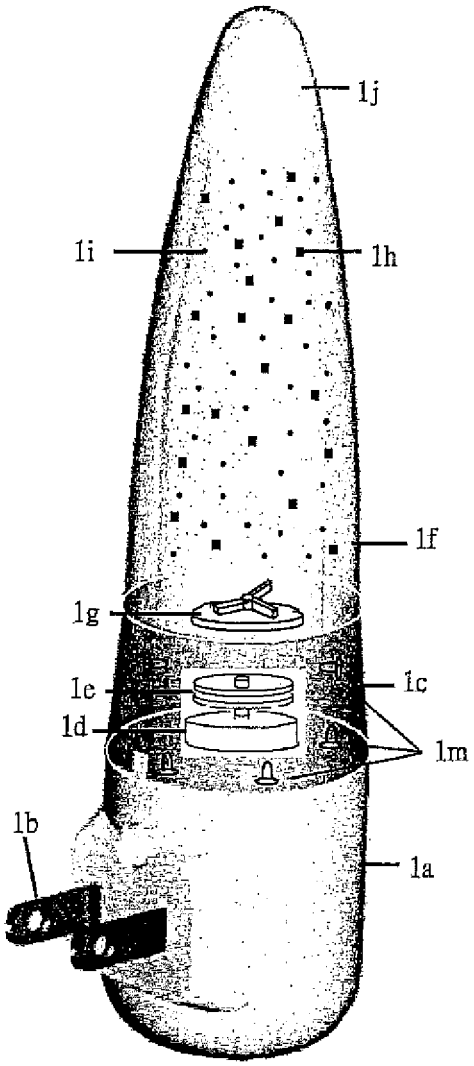
FIGS. 1, 2-5, 3-5, and 4-3 to 4-5 are perspective views of a night light with a liquid container as disclosed in the inventor's copending application.
Figures 3, 4, 5:
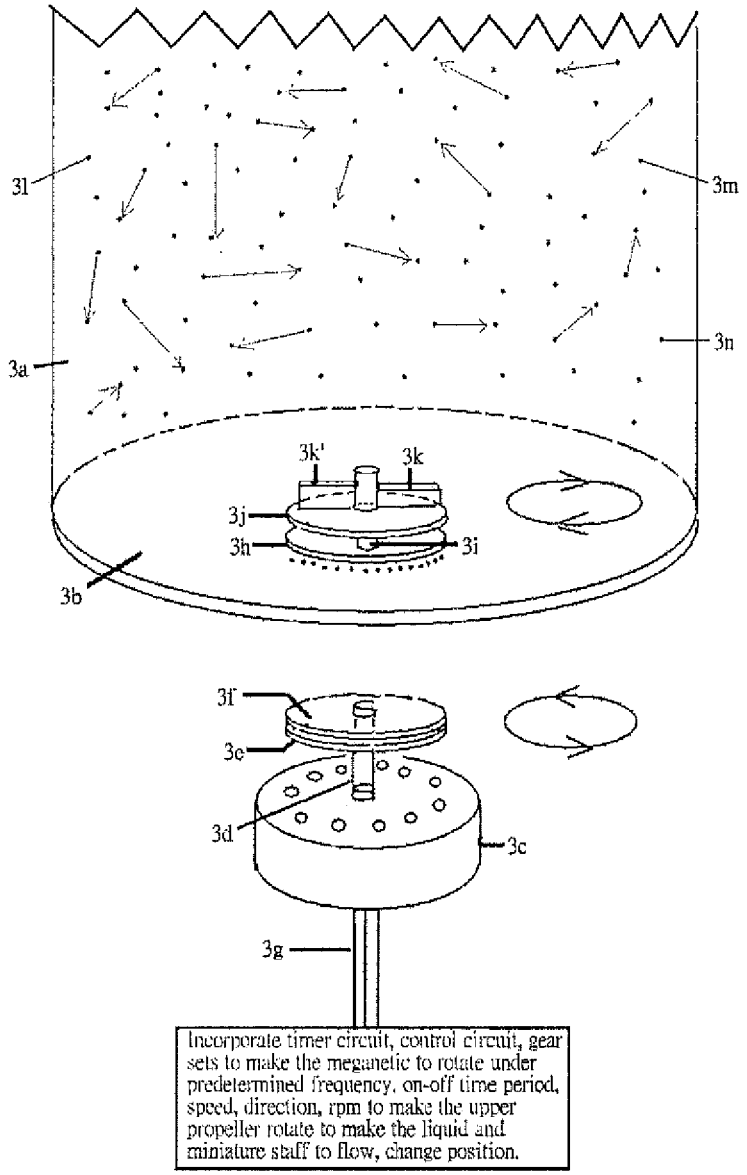

FIG. 1 shows a first embodiment of a liquid container 1*f* having a propeller 1*g* and magnetic means to cause a small amount of liquid/fluid 1*i* with miniatures 1*h* to flow with high speed injection to create water peaks. A motor 1*d* is installed on a base 1*a* and controlled by a preferred IC means or circuit means in base 1*a*, and has magnetic means 1*e*. The propeller's magnetic means causes rotation of the propeller 1*g* in response to rotation of the motor's magnet means 1*e*, resulting in fluid flow in desired direction(s) and for a certain period of time. Power is supplied through prongs 1*b*. The built-in LED (or LEDs) 1*m* and circuit means cause the LED to emit light according to a pre-determined function, color, and brightness and may be incorporated with optics means 1*j* on top of the container to project the desired image or light beams with color changing performance. FIG. 3-5 shows details of the motor/propeller arrangement of FIG. 1, including motor 3*c* connected to the circuitry by wires 3*g*, shaft 3*d*, rotor 3*c* with magnet 3*f*, container base 3*b*, propeller magnet means 3*h*, shaft 3*i*, propeller base 3*j*, and blades 3*k* and 3*k'*. The arrows shown in FIG. 3-5 indicate the resulting movement of miniatures 3*l*, 3*m*, and 3*n* in liquid 3*a*.

Figure 4:
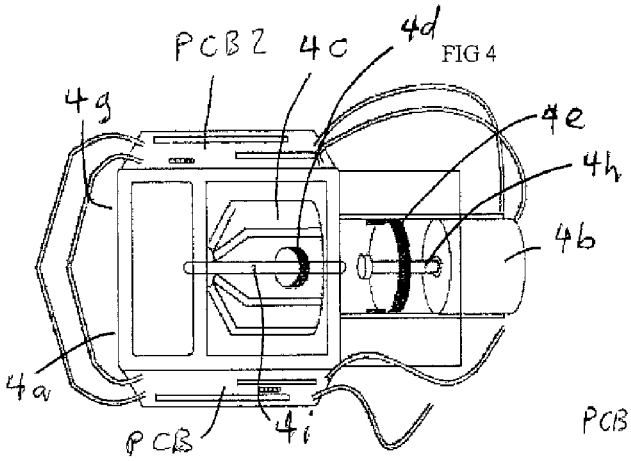
Figures 1, 4:
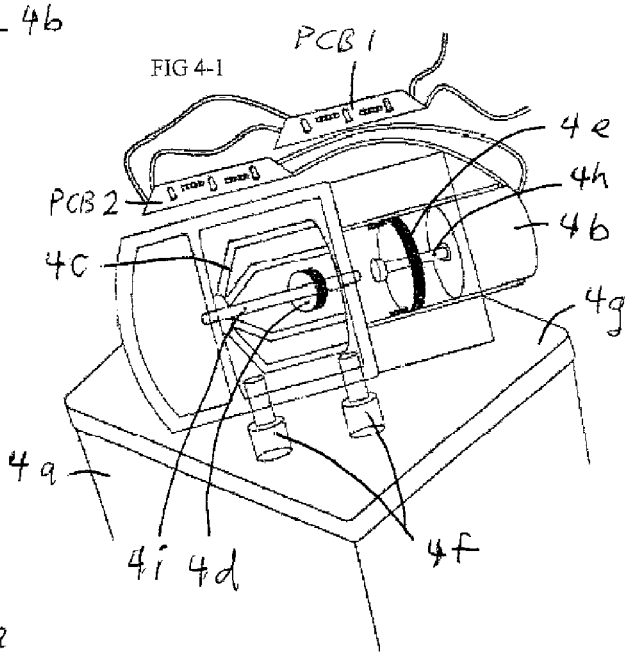
Figures 2, 4:
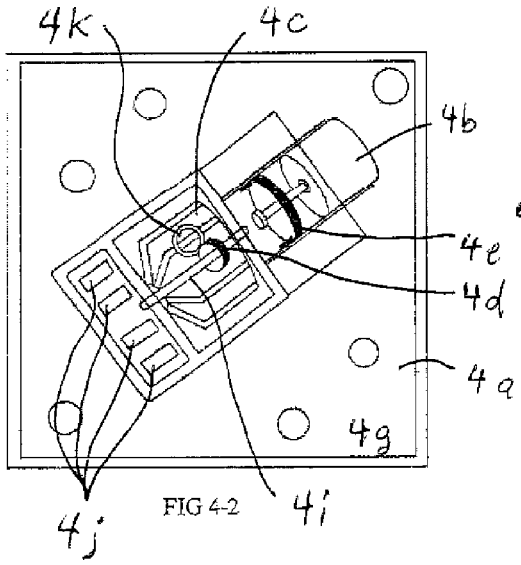
Figures 3, 4:
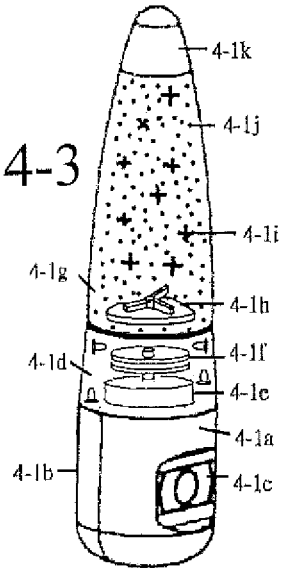
Figure 4:
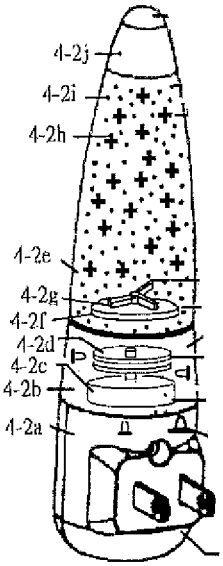
Figures 4, 5:
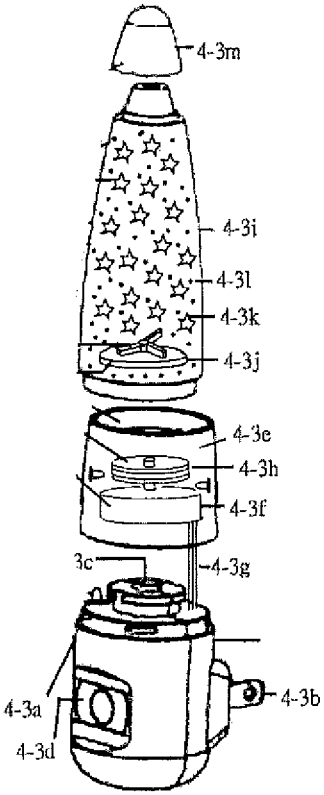
Figures 1, 5:
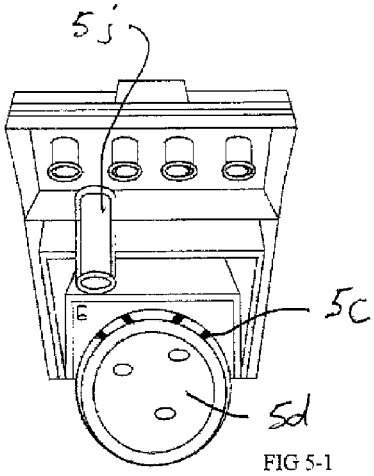
Figure 5:
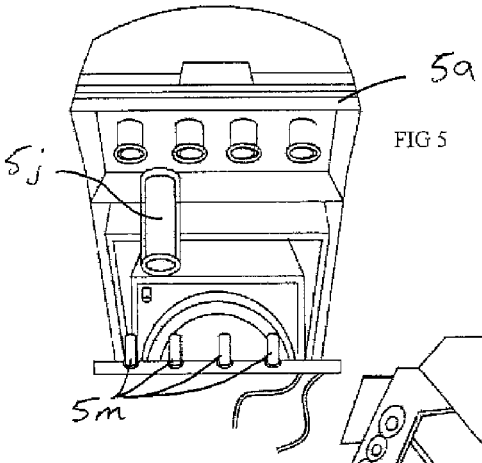
Figures 3, 5:
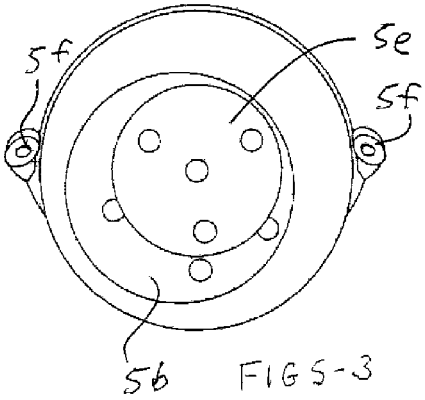
Figures 2, 5:
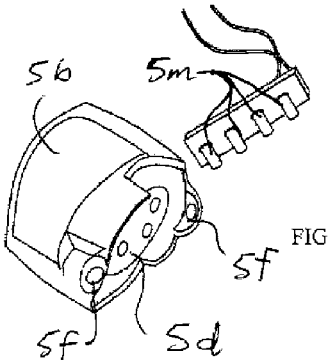
Figures 4, 5:
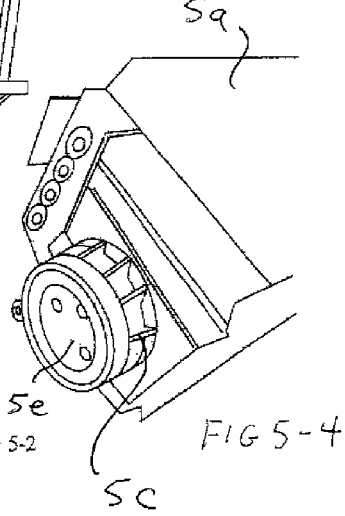

FIGS. 2, 2-1, 2-2, 2-3, 2-4, 3-1, 3-2, 3-3, and 3-4 show a second embodiment with a liquid container having a propeller and magnetic means to cause a large amount of liquid/fluid to flow out of a large output opening(s) with a slow speed into a high level liquid/fluid. As explained in the text boxes included in the original drawings, the liquid/fluid level is variable to provide different functions, with the floating miniatures moving up and down when the water level is full, and a dance function being obtained when the water openings are narrowed to cause the liquid/fluid to accelerate through the openings. The motor is controlled by a preferred IC means or circuit means and a sensor means, switch means, trigger means, or activation means. The motor has magnetic means that reacts with a propeller's magnetic means so as to cause rotation and fluid flow in desired directions for a certain period of time. The built-in LED (or LEDs) and circuit means cause the LED to emit light according to a pre-determined function, color, and brightness, and may be incorporated with optics means on top of the container to project a desired image or light beams with color changing performance. In particular, the top of the light device may include a built-in optics lens to project an image of the container's moving miniatures or waves onto a desired location, such as on a ceiling or wall. The circuit means can create different LED light shows for a selected timing and duration, and to control motor speed to cause different waves and peaks. The power supply can be a plug-in type, as shown in FIG. 2-1, or can utilize USB power, an adaptor with a UL listed transformer, battery pack, or any other energy source or storage means. The miniatures has a weight and density relative to the liquid to move up and down when the water level is much higher than the input and output openings when the propeller rotates at an appropriate RPM. FIGS. 2-3 and 2-4 show the situation in which the water level is much higher hand the input/output opening of the propeller/magnetic means.

FIGS. 4, 4-1, and FIG. 4-2 show the detailed construction of the second preferred embodiment, which includes a liquid container 4*a*, motor means 4*b*, propeller means 4*c*, first magnetic means 4*d*, second magnetic means 4*e*, PCB 1, PCB 2, PCB hold pole 4*f*, a container base 4*g*, a motor axis 4*h*, a propeller axis 4*i*, input and output openings 4*j*, 4*k*, a light passing piece 4*l*, an LED 4*m*, a base 4*n*, sensor means, electric means and inner circuit means. The container has a variety of designs of miniature stuff and/or a liquid/fluid/particles/air/glitter. The miniature stuff may be in round pieces, rectangular pieces, star shapes, heart shapes, cartoon characters or any geometric shapes. The light passing piece 4*l* can be a transparent or translucent material based on market requirements. The LED number can be any number from one to N for desired light performance. Also shown are details of the preferred construction to achieve a slow flow and cause the inner stuff to move in certain directions with projection to desired locations. The propeller and magnetic piece has base which is glued on the bottom of the liquid container. The propeller and magnetic piece are rotate in response to rotation of the motor and its magnetic piece, which are installed on the outside of the liquid container. The motor is incorporated with control means to obtain a certain speed, rotating time, and duration of rotation to cause the inner miniatures or liquid/fluid/particles/air/chemicals/compounds to move at a correct speed to desired directions, resulting in eye-catching motion effects of the miniature stuff.

FIGS. 5, 5-1, 5-2, 6, and 6-1 show the detailed construction of the first preferred embodiment, including a liquid container 5*a*, motor means 5*b*, propeller means 5*c*, first magnetic means 5*d*, second magnetic means 5*e*, PCB 1, PCB 2, PCB hold pole 5*f*, container base 5*g*, motor axis 5*h*, propeller axis 5*i*, input and output openings 5*j*, 5*k*, a light passing piece 5*l*, an LED 5*m*, a base 5*n*, sensor means, electric means and inner circuit means. The container has a variety of designs of miniature stuff and/or liquid/fluid/particles/air/glitters. The miniature stuff may be round pieces, rectangular pieces, star shapes, heart shapes, cartoon characters or any geometric shapes. The light passing piece can be a transparent or translucent material based on market requirements. The LED number can be any number from one to N for desired light performance. Also shown are the tiny output openings 5*o* which increase the speed of liquid injection from the tiny output openings to cause water peaks make the water dance under a predetermined motor speed control by conventional IC means or sensor means, variable electric means, trigger means, or other electric parts and accessories. The propeller and magnetic piece have a base which is glued on the bottom of the liquid container. Those skilled in the art will appreciate that, although tiny fluid inlet openings 5*j* and outlet openings 5*o* are illustrated in, for example, FIGS. 6, and 6-1, larger openings such as openings 4*j* illustrated in FIG. 4-2 will result in slower movement of the fluid rather than the above-mentioned water dance effect.

The propeller and magnetic piece are rotated by the motor and its magnetic piece, which are installed on the outside of the liquid container. The motor is incorporated with control means to obtain a certain speed, rotating time, and duration of rotation to cause the inner miniatures and/or liquid/fluid/particles/air/chemicals/compounds to move at a correct speed in desired directions to cause eye-catching motion effects of the miniature stuff.

FIG. 3-4 shows a battery powered LED light which at least has miniature stuff arranged to move along a desired path and directions, built-in night light or projection light, and motor means incorporated with magnetic means. The inner miniatures here are chemicals or particles that can move like a volcano.

FIG. 3-3 shows an AC powered LED light which at least has moving miniature stuff, a built-in night light and/or projection light, and motor means incorporated with magnetic means. The inner miniatures here are glitter or reflective particles which have a certain density relative to the inner liquid/fluid so as to float within the liquid/fluid medium.

FIGS. 4-1, 5, 5-1, and 5-2 show an AC powered LED light which has more than one LED, more than one optics means, and more one reflective means to cause the LED light to emit light beams in different directions, thereby illuminating the container and enabling projection of the light beams through optics means on top of the container.

Figure 6:
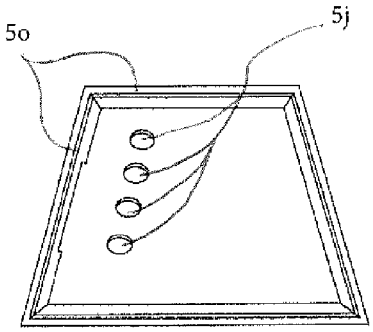
Figures 1, 6:
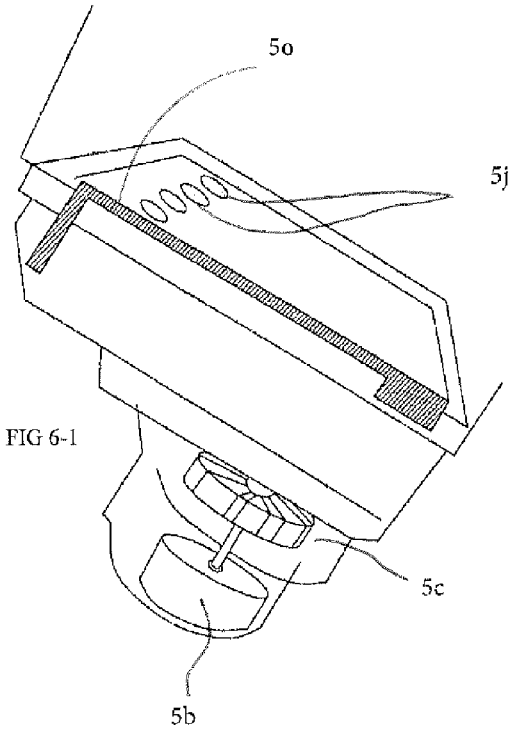

FIGS. 6 and 6-1 show details of the liquid/fluid openings. The input openings 6*a* at the base of the container in this embodiment have tiny holes for accelerated liquid injection upon rotation of the propeller 5*b* in response to rotation of the motor 5*c* at an appropriate RPM, surrounded by transparent areas for emission of LED light. As shown in FIG. 6-1 and explained in the text box included in the original drawings, the peaks are most visible if the liquid/fluid level is shallow. If the liquid/fluid level is high, the peaks or jets will be deformed within the liquid/fluid medium.

The invention claimed is:

1. An LED light device, comprising:

at least one container that contains a fluid inlet opening, a fluid outlet opening, and a fluid including at least one of a plurality of miniatures, a liquid, a chemical, air, particles, or solid pieces;

at least one propeller surrounded by said fluid and mounted on an inner bottom of the container below an area visible from outside the container, said propeller being rotatable to cause vertical movement of the fluid from the fluid inlet opening to the fluid outlet opening, thereby causing movement of at least one of the miniatures, liquid, chemical, air, particles, or solid pieces in predetermined directions and at a predetermined speed, timing, or speed and timing, and/or for a predetermined time period;

a first magnetic piece located inside the at least one container and rotatable with said at least one propeller;

a motor situated outside the fluid-containing container and a second magnetic piece mounted on plate that is fixed to a shaft of the motor, wherein the second magnetic piece is magnetically coupled with the first magnetic piece to cause rotation of said first magnetic piece and said at least one propeller upon rotation of said motor shaft and second magnetic piece;

at least one LED arranged to transmit light through the container and/or the miniatures, fluid, liquid, chemical, air, particles, or solid pieces included in the container when supplied with electricity from a power source; and at least one image-projecting transparent optical element located at a top of the container for magnifying and/or refracting light that has passed through at least one of the container, the miniatures, liquid, chemical, air, particles, or solid pieces included in the container, the light magnified and/or refracted by the transparent optical element forming an image on a surface outside the LED light device, the image including motion effects caused by movement of the miniatures, fluid, liquid, chemical, air, particles, or solid pieces included in the container, and wherein the LED device is a non-battery-powered device that is supplied with power from an external source selected from a transformer, an AC wire with a plug, a USB port and connecting wire, an AC power outlet, a solar power source, and a generator.

2. An LED light device as claimed in claim 1, wherein a size of the fluid inlet openings and outlet openings determines a speed of movement of a fluid in the container, wherein large outlet openings result in slow movement or fountain effect and smaller outlet openings result in peaks of accelerated fluid movement when the fluid is moved by the propeller to obtain a vertical or high-low position of movement or water dance effect.

3. An LED light device as claimed in claim 2, wherein said miniatures, fluid, liquid, chemical, air, particles, or solid pieces are caused to move in a pattern.

4. An LED light device as claimed in claim 2, wherein said at least one LED includes at least two LEDs arranged to provide a predetermined light performance.

5. An LED light device as claimed in claim 4, wherein a first of the at least two LEDs is a projection light source and a second of the at least two LEDs illuminates the container.

6. An LED light device as claimed in claim 2, wherein the LED light device includes additional functions selected from an LED light, a motion sensor light, a power fail light, and a photosensor controlled light.

7. An LED light device, comprising:

a container;

a base;

a top cover; and at least a first LED and a second LED, wherein the container includes (a) a fluid or (b) a fluid and miniatures, a liquid, solid pieces, or chemicals arranged to move vertically in response to movement of a propeller surrounded by the fluid in a lower bottom of the container, the propeller being coupled to a motor by respective first and second magnetic elements on the propeller and on a rotatable plate fixed to a shaft of the motor, wherein the LED light device includes a projection optics assembly on a top of the container for projecting an image on a surface outside the LED light device, the image including motion effects caused by movement of the miniatures, fluid, liquid, solid pieces, or chemicals, wherein light from the second LED is visible from outside the light device by passing directly through the container, and wherein the LED device is a non-battery-powered device that is supplied with power from an external source selected from a transformer, an AC wire with a plug, a USB port and connecting wire, an AC power outlet, a solar power source, and a generator.

8. An LED light device as claimed in claim 7, wherein the at least one first LED and the second LED emit light in different directions to be viewed by viewers in different locations.

9. An LED light having an injected or pumped fluid display, comprising:

at least one container that contains a fluid including at least one of a plurality of miniatures, a fluid, a liquid, a chemical, air, particles, or solid pieces;

at least one propeller surrounded by said fluid and mounted on an inner bottom of the at least one container below an area visible from outside the container, said propeller being rotatable to cause movement of at least one of the miniatures, fluid, liquid, chemical, air, smoke, particles, or solid pieces in predetermined directions and at a predetermined speed, timing, or speed and timing, and/or for a predetermined time period;

a first magnetic piece located inside the at least one container and rotatable with said at least one propeller;

a motor situated outside the fluid-containing container and a second magnetic piece mounted on plate that is fixed to a shaft of the motor, wherein the second magnetic piece is magnetically coupled with the first magnetic piece to cause rotation of said first magnetic piece and said at least one propeller upon rotation of said motor shaft and second magnetic piece;

at least one LED arranged to transmit light through the container and/or the miniatures, fluid, liquid, chemical, air, particles, or solid pieces included in the container when supplied with electricity from a power source, and at least one fluid inlet located in a base of the container for supplying the fluid to a lower propeller area of the container and that provides a pumping effect for pumping inlet fluid to an outlet area for outlet through at least one outlet opening to expel fluid from the base of the container into a display area of the container, wherein a height and force at which fluid is expelled from the base of the container into the display area is controlled by a cross-sectional size of the at least one outlet opening, wherein performance effects of the injected or pumped fluid display are further determined by, at least, a fluid amount, a configuration of the at least one fluid inlet, the cross-sectional size of the at least one outlet opening, a propeller size, and operational characteristics of the motor, and wherein the LED device is a non-battery-powered device that is supplied with power from an external source selected from a transformer, an AC wire with a plug, a USB port and connecting wire, an AC power outlet, a solar power source, and a generator.

* * * * *